US005700229A

United States Patent [19]

Karnofsky

[11] Patent Number: 5,700,229

[45] Date of Patent: Dec. 23, 1997

[54] MARTIAL ARTS TARGET

[76] Inventor: Glenn Karnofsky, P.O. Box 667, Carnelian Bay, Calif. 96140

[21] Appl. No.: 607,992

[22] Filed: Mar. 4, 1996

[51] Int. Cl.[6] ..... A63B 21/00

[52] U.S. Cl. ..... 482/83; 482/87

[58] Field of Search ..... 482/83–90; 601/118, 601/119, 120, 124

[56] References Cited

U.S. PATENT DOCUMENTS

| | | | |
|---|---|---|---|
| 4,817,941 | 4/1989 | McCorry | 272/76 |
| 4,884,560 | 12/1989 | Kuranana | 128/243 |
| 5,026,048 | 6/1991 | Jones | 272/77 |
| 5,261,821 | 11/1993 | Shic | 434/247 |
| 5,277,679 | 1/1994 | Wells | 482/83 |
| 5,389,057 | 2/1995 | Zagata | 482/83 |

*Primary Examiner*—Jerome Donnelly

*Attorney, Agent, or Firm*—David H. T. Wayment

[57] ABSTRACT

A martial arts target made of nested tubes filled with sand is disclosed. The target has loops of steel cable which allow the target to be attached to various stationary objects.

7 Claims, 1 Drawing Sheet

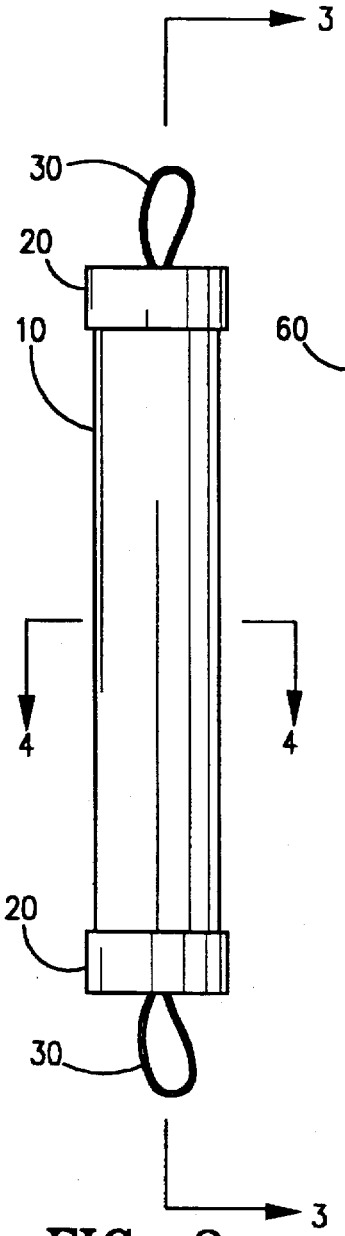
FIG. 2
FIG. 3
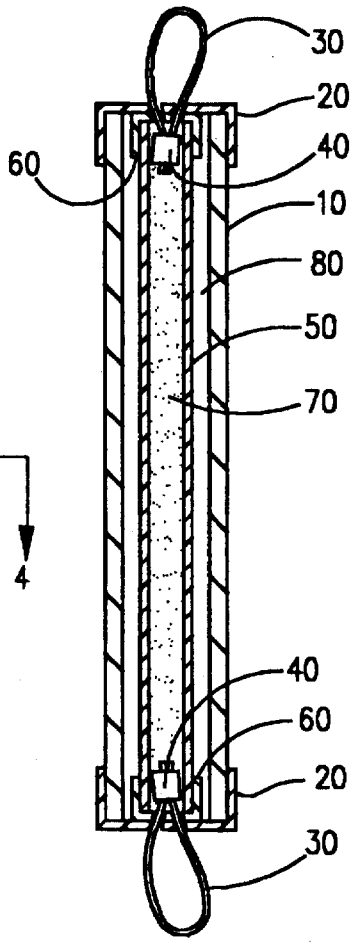
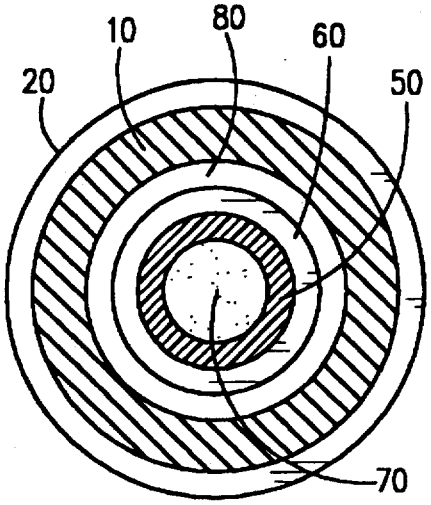
FIG. 4
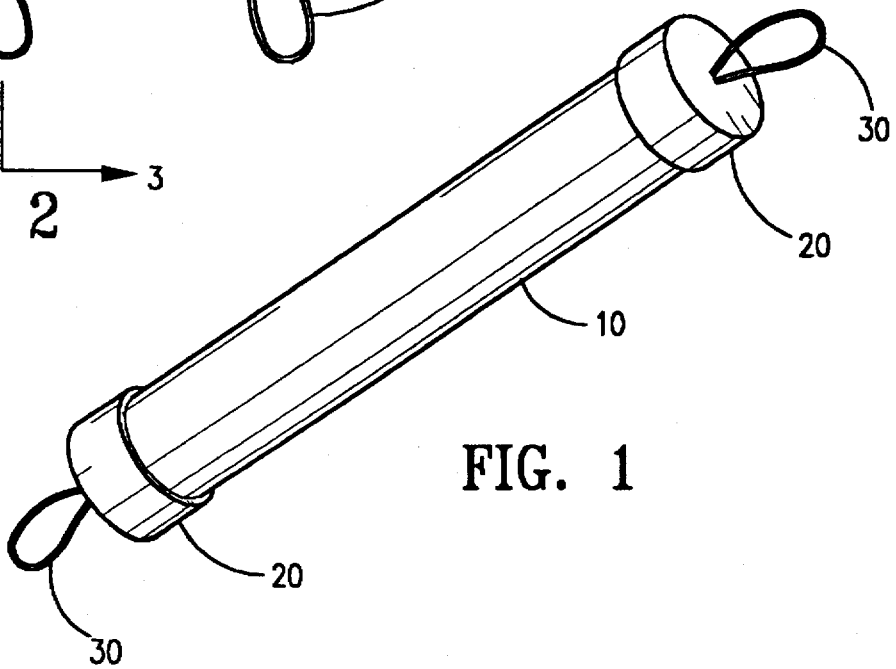
FIG. 1

MARTIAL ARTS TARGET

BACKGROUND OF THE INVENTION

1. Field of the Invention

This invention relates generally to the field of sports equipment. Specifically, the invention is a target for practicing the use of martial arts weapons.

2. Description of Related Art

For many years, people have shown an interest in learning the martial arts, either as part of a physical fitness program, for self-defense, or both. Many of the martial arts have, as part of their program, the use of various hand-held weapons. Students of the martial arts who wish to practice the use of these weapons have long found it advantageous to practice on an inanimate target.

As shown in the accompanying information disclosure statement, several inventors have patented various types of targets and systems for holding targets.

Experience teaches, however, that the prior art targets have one of two drawbacks. First, many of the prior art targets are quickly and easily destroyed by the weapons, necessitating frequent replacement of the targets at great expense and inconvenience. Second, some of the prior art targets are so strong that they actually damage and, eventually, destroy the weapons, at an even greater cost and inconvenience.

Accordingly, there has been a need for a new martial arts target which is tough enough to withstand very severe use by martial arts practitioners, and yet have qualities which allow the target to be used for sustained periods of time without damaging the weapons used.

SUMMARY OF THE INVENTION

A target which meets the foregoing needs and other objects is disclosed. The target is comprised of a piece of fabric reinforced synthetic rubber tubing which has a piece of plastic (such as poly-vinyl chloride, "PVC") pipe inserted into it. While PVC is appropriate because of its ready availability, durability, rigidness, and low cost, any suitably rigid and durable plastic pipe could be substituted for PVC pipe. The PVC pipe is then filled with sand and the target is capped at both ends. While ordinary fine sand is particularly appropriate because of its ready availability and low cost, any fine, granular substance could be substituted for sand. Additionally, both ends of the target have a looped piece of steel cable attached to facilitate mounting or hanging the target. The target may be used by itself, or it may be combined with other targets of the same design in various configurations. For example, two or more targets could be joined together to form a circular shape, or any other shape desired.

It is an object of the invention to produce a martial arts target which is strong enough to withstand long-term, severe use by practitioners of the martial arts.

It is a further object of the invention to produce a target which has energy absorbing characteristics which allow the target to be used by practitioners of the martial arts without fear of damaging the martial arts weapons being used.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

BRIEF DESCRIPTION OF THE DRAWINGS

FIG. 1 is a perspective view of the invention.

FIG. 2 is an elevational view of the invention.

FIG. 3 is a cross-sectional view of the invention, with the invention cut parallel to its long axis.

FIG. 4 is a cross-sectional view of the invention, with the invention cut perpendicular to its long axis.

DESCRIPTION OF PREFERRED EMBODIMENT

FIG. 1 is a perspective view of the target showing the outer tube, 10, with two ends, the tube, 10, being made of fabric reinforced synthetic rubber, two soft plastic caps, 20, on each end of the tube, 10, and a piece of looped steel cable, 30, protruding through each of the caps, 20. In a typical application, the target would be approximately four feet long with an outer diameter of approximately three inches.

FIG. 2 is an elevational view of the target showing the outer tube, 10, the caps, 20, and the looped steel cable, 30.

FIG. 3 is a cross-sectional view of the target, taken along the section indicated in FIG. 2, showing the outer tube, 10, the caps, 20, the steel cable, 30, metal crimps, 40, for securing the cable, 30, an inner section of PVC pipe, 50, with two ends, and with PVC caps, 60, on each end of the pipe, 50, and sand, 70, inside the pipe, 50. In this view, it can be seen that the steel cable, 30, protrudes through the PVC cap, 20, before being secured with a metal crimp, 40. This view also shows that there is a gap, 80, between the outer tube, 10, and the inner section of pipe, 50.

FIG. 4 is also a cross-sectional view of the target, taken along the section indicated in FIG. 2, showing a soft plastic cap, 20, the outer tube, 10, the gap, 80, a PVC cap, 60, the inner pipe, 50, and the sand, 70.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A martial arts target comprising:

an outer tube having a length and having two ends;

an inner tube having a length and having two ends which is inserted inside the outer tube; wherein a gap exit between an outer diameter of the inner tube and an inner diameter of the outer tube substantially along the length of the inner and outer tube;

a quantity of granular substance located inside of the inner tube which occupies essentially the entire volume of the inner tube;

an inner tube cap member attached to each of the respective ends of the inner tube;

an outer tube cap member attached to each end of the outer tube, thereby covering the inner tube and the inner tube caps and;

looped attaching means attached to and protruding through at least one of the inner tube caps and at least one of the outer tube caps on each end of the target.

2. A martial arts target as set forth in claim 1 wherein the outer tube is synthetic rubber.

3. A martial arts target as set forth in claim 1 wherein the inner tube is plastic pipe.

4. A martial arts target as set forth in claim 1 wherein the inner tube caps are hard plastic.

5. A martial arts target as set forth in claim 1 wherein the outer tube caps are soft plastic.

6. A martial arts target as set forth in claim 1 wherein the looped attaching means are looped pieces of steel cable.

7. A martial arts target as set forth in claim 1 wherein the inner tube is of approximately the same length as the outer tube and wherein the outer tube forms a continuous protective covering over the surface of the inner tube.

* * * * *